US011112140B2

(12) United States Patent
Shimazu

(10) Patent No.: US 11,112,140 B2
(45) Date of Patent: Sep. 7, 2021

(54) AIR CONDITIONING APPARATUS

(71) Applicant: Mitsubishi Electric Corporation, Tokyo (JP)

(72) Inventor: Yusuke Shimazu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 31 days.

(21) Appl. No.: 16/639,651

(22) PCT Filed: Sep. 7, 2017

(86) PCT No.: PCT/JP2017/032238
§ 371 (c)(1),
(2) Date: Feb. 17, 2020

(87) PCT Pub. No.: WO2019/049255
PCT Pub. Date: Mar. 14, 2019

(65) Prior Publication Data

US 2020/0173682 A1 Jun. 4, 2020

(51) Int. Cl.
*F24F 11/84* (2018.01)
*F24F 11/75* (2018.01)
(Continued)

(52) U.S. Cl.
CPC ..... *F24F 11/84* (2018.01); *F24F 1/0059* (2013.01); *F24F 1/32* (2013.01); *F24F 11/75* (2018.01); *F24F 11/86* (2018.01); *F24F 2110/40* (2018.01)

(58) Field of Classification Search
CPC .. F24F 11/75; F24F 11/84; F24F 11/86; F24F 1/0059; F24F 1/32; F25B 2400/13; F25B 2313/021
See application file for complete search history.

(56) References Cited

U.S. PATENT DOCUMENTS 7,114,349 B2 * 10/2006 Lifson ..... F25B 41/20 62/513
2006/0123840 A1 * 6/2006 Lifson ..... F25B 40/00 62/513
(Continued)

FOREIGN PATENT DOCUMENTS

CN 103836847 A 6/2014
CN 105042943 A 11/2015
(Continued)

OTHER PUBLICATIONS

Chinese Office Action dated Feb. 3, 2021, issued in corresponding Chinese Patent Application No. 201780094386.9 (and English Machine Translation).
International Search Report of the International Searching Authority dated Nov. 28, 2017 for the corresponding International application No. PCT/JP2017/032238 (and English translation).

*Primary Examiner* — Nelson J Nieves
(74) *Attorney, Agent, or Firm* — Posz Law Group, PLC

(57) ABSTRACT

An air conditioning apparatus includes: a supercooling heat exchanger configured to supercool refrigerant flowing in a first flow path between an outdoor heat exchanger and an expansion valve; a flow path switching valve configured to switch a flow path between an indoor heat exchanger and a compressor to one of a second flow path that does not extend through the supercooling heat exchanger and a third flow path that extends through the supercooling heat exchanger; a bypass circuit that is branched from the first flow path and extends through the supercooling heat exchanger; and a bypass regulating valve provided in the bypass circuit; and a controller. In a cooling operation, when a load is not low, the controller selects the second flow path and opens the bypass regulating valve, whereas when the load is low, the controller selects the third flow path and closes the bypass regulating valve.

6 Claims, 7 Drawing Sheets

(51) Int. Cl.

| | |
|---|---|
| ***F24F 11/86*** | (2018.01) |
| ***F24F 1/0059*** | (2019.01) |
| ***F24F 1/32*** | (2011.01) |
| *F24F 110/40* | (2018.01) |

(56) References Cited

U.S. PATENT DOCUMENTS

| | | | | |
|---|---|---|---|---|
| 2006/0191288 | A1* | 8/2006 | Radermacher | F25B 9/008 62/510 |
| 2007/0107451 | A1* | 5/2007 | Sakurai | F25B 31/008 62/228.3 |
| 2007/0125121 | A1* | 6/2007 | Suzuki | F25B 9/008 62/513 |
| 2011/0154847 | A1* | 6/2011 | Itakura | F25B 13/00 62/324.6 |
| 2015/0292756 | A1* | 10/2015 | Takenaka | F24F 5/001 62/160 |
| 2019/0049155 | A1* | 2/2019 | Tanaka | F25B 13/00 |

FOREIGN PATENT DOCUMENTS

| | | | | | |
|---|---|---|---|---|---|
| EP | 2735819 | A2 | | 5/2014 | |
| JP | H03-084352 | A | | 4/1991 | |
| JP | H10-068553 | A | | 3/1998 | |
| JP | 2001-317832 | A | | 11/2001 | |
| JP | 2006300373 | A | * | 11/2006 | F25B 13/00 |
| JP | 2010-230288 | A | | 10/2010 | |

* cited by examiner

FIG.2

| | FIRST COOLING OPERATION MODE | SECOND COOLING OPERATION MODE | HEATING OPERATION MODE |
|---|---|---|---|
| FOUR-WAY VALVE | COOLING OPERATION STATE | COOLING OPERATION STATE | HEATING OPERATION STATE |
| FLOW PATH SWITCHING VALVE | FIRST STATE | SECOND STATE | FIRST STATE |
| BYPASS REGULATING VALVE | OPEN STATE | CLOSE STATE | CLOSE STATE |

AIR CONDITIONING APPARATUS

CROSS REFERENCE TO RELATED APPLICATION

This application is a U.S. national stage application of PCT/JP2017/032238 filed on Sep. 7, 2017, the contents of which are incorporated herein by reference.

TECHNICAL FIELD

The present disclosure relates to an air conditioning apparatus, particularly, an air conditioning apparatus including a heat exchanger for supercooling refrigerant at an upstream side relative to an expansion valve during a cooling operation.

BACKGROUND ART

Conventionally, an air conditioning apparatus has been known in which a plurality of indoor units are connected to one outdoor unit in parallel. In such an air conditioning apparatus, an expansion valve is disposed in the indoor unit. Only liquid-phase refrigerant desirably flows into the expansion valve. When two-phase refrigerant including both a liquid phase and a gas phase flows into the expansion valve, the liquid phase and the gas phase alternately pass discontinuously to cause a pressure fluctuation, thus resulting in generation of a refrigerant sound from the expansion valve. In order to suppress the generation of such a refrigerant sound, there has been developed a technique for providing a heat exchanger for supercooling the refrigerant at an upstream side relative to the expansion valve.

For example, Japanese Patent Laying-Open No. 2001-317832 (Patent Literature 1) discloses a supercooling heat exchanger configured to supercool high-pressure refrigerant during a cooling operation by exchanging heat between high-pressure refrigerant flowing from the outdoor heat exchanger into the expansion valve and low-pressure refrigerant flowing from the indoor heat exchanger into the compressor.

Japanese Patent Laying-Open No. 10-68553 (Patent Literature 2) discloses a supercooling heat exchanger configured to supercool mainstream refrigerant by exchanging heat between low-pressure bypass flow refrigerant and high-pressure mainstream refrigerant. The low-pressure bypass flow refrigerant is branched from a main circuit between a condenser and an expansion valve and passes through a capillary tube. The high-pressure mainstream refrigerant flows in the main circuit.

CITATION LIST

Patent Literature

PTL 1: Japanese Patent Laying-Open No. 2001-317832
PTL 2: Japanese Patent Laying-Open No. 10-68553

SUMMARY OF INVENTION

Technical Problem

In the technique described in Japanese Patent Laying-Open No. 2001-317832, a flow path from the indoor heat exchanger to the compressor extends through the supercooling heat exchanger. Hence, when a cooling load becomes large, pressure loss in the flow path is increased. In order to suppress the pressure loss, the supercooling heat exchanger needs to be increased in size, thus resulting in increased cost for the supercooling heat exchanger.

In the technique described in Japanese Patent Laying-Open No. 10-68553, a flow path from the indoor heat exchanger to the compressor does not extend through the supercooling heat exchanger. Hence, pressure loss can be suppressed from being increased in the flow path. However, part of the circulating mainstream refrigerant passes through the supercooling heat exchanger as bypass flow refrigerant. Hence, when a cooling load becomes small, a flow rate of the mainstream refrigerant from the supercooling heat exchanger to the expansion valve becomes too small. As a result, when the mainstream refrigerant flows in a pipe from the supercooling heat exchanger to the expansion valve, an amount of heat received and absorbed by the mainstream refrigerant from external air via the pipe becomes large, with the result that part of the refrigerant may become a gas phase at an inlet of the expansion valve to cause generation of a refrigerant sound from the expansion valve.

An object of the present disclosure is to provide an air conditioning apparatus that can suppress increase of pressure loss between an indoor heat exchanger and a compressor and that can suppress generation of a refrigerant sound in an expansion valve.

Solution To Problem

An air conditioning apparatus according to the present disclosure includes: an outdoor unit including a compressor and an outdoor heat exchanger; at least one indoor unit including an expansion valve and an indoor heat exchanger; and a main circuit configured to circulate refrigerant through the compressor, the outdoor heat exchanger, the expansion valve, and the indoor heat exchanger. The main circuit includes a first flow path between the outdoor heat exchanger and the expansion valve. The air conditioning apparatus further includes a supercooling heat exchanger configured to supercool the refrigerant flowing in the first flow path. As a flow path between the indoor heat exchanger and the compressor, the main circuit includes a second flow path that does not extend through the supercooling heat exchanger, and a third flow path that extends through the supercooling heat exchanger. The air conditioning apparatus further includes a flow path switching valve, a bypass circuit, a bypass regulating valve, and a controller. The flow path switching valve is configured to switch, to one of the second flow path and the third flow path, the flow path between the indoor heat exchanger and the compressor. The bypass circuit is branched from the first flow path, extends through the supercooling heat exchanger, and is joined to the main circuit. The bypass regulating valve is provided in the bypass circuit. The controller is configured to control the flow path switching valve and the bypass regulating valve. In a cooling operation, when a parameter correlated with a flow rate of the refrigerant in the main circuit indicates that the flow rate of the refrigerant is more than a reference value, the controller is configured to control the flow path switching valve to switch, to the second flow path, the flow path between the indoor heat exchanger and the compressor, and open the bypass regulating valve. In the cooling operation, when the parameter indicates that the flow rate of the refrigerant is less than the reference value, the controller is configured to control the flow path switching valve to switch, to the third flow path, the flow path between the indoor heat exchanger and the compressor, and close the bypass regulating valve.

Advantageous Effects of Invention

According to the present disclosure, in the case where the load is low, i.e., in the case where the parameter indicates that the flow rate of the refrigerant is less than the reference value, the bypass regulating valve is closed. Hence, an amount of absorbed heat of the refrigerant from the supercooling heat exchanger to the expansion valve can be suppressed, whereby a refrigerant sound generated from the expansion valve can be suppressed. In the case where the load is not low, i.e., in the case where the parameter indicates that the flow rate of the refrigerant is more than the reference value, the flow path between the indoor heat exchanger and the compressor is switched to the second flow path that does not extend through the supercooling heat exchanger. Accordingly, pressure loss in the flow path between the indoor heat exchanger and the compressor can be suppressed from being increased. In the manner described above, it is possible to provide an air conditioning apparatus that can suppress increase of pressure loss between an indoor heat exchanger and a compressor and that can suppress generation of a refrigerant sound in an expansion valve.

BRIEF DESCRIPTION OF DRAWINGS

FIG. 2 shows a relation between an operation mode of the air conditioning apparatus and each of states of a four-way valve, a flow path switching valve, and a bypass regulating valve.

DESCRIPTION OF EMBODIMENTS

Figure 1:
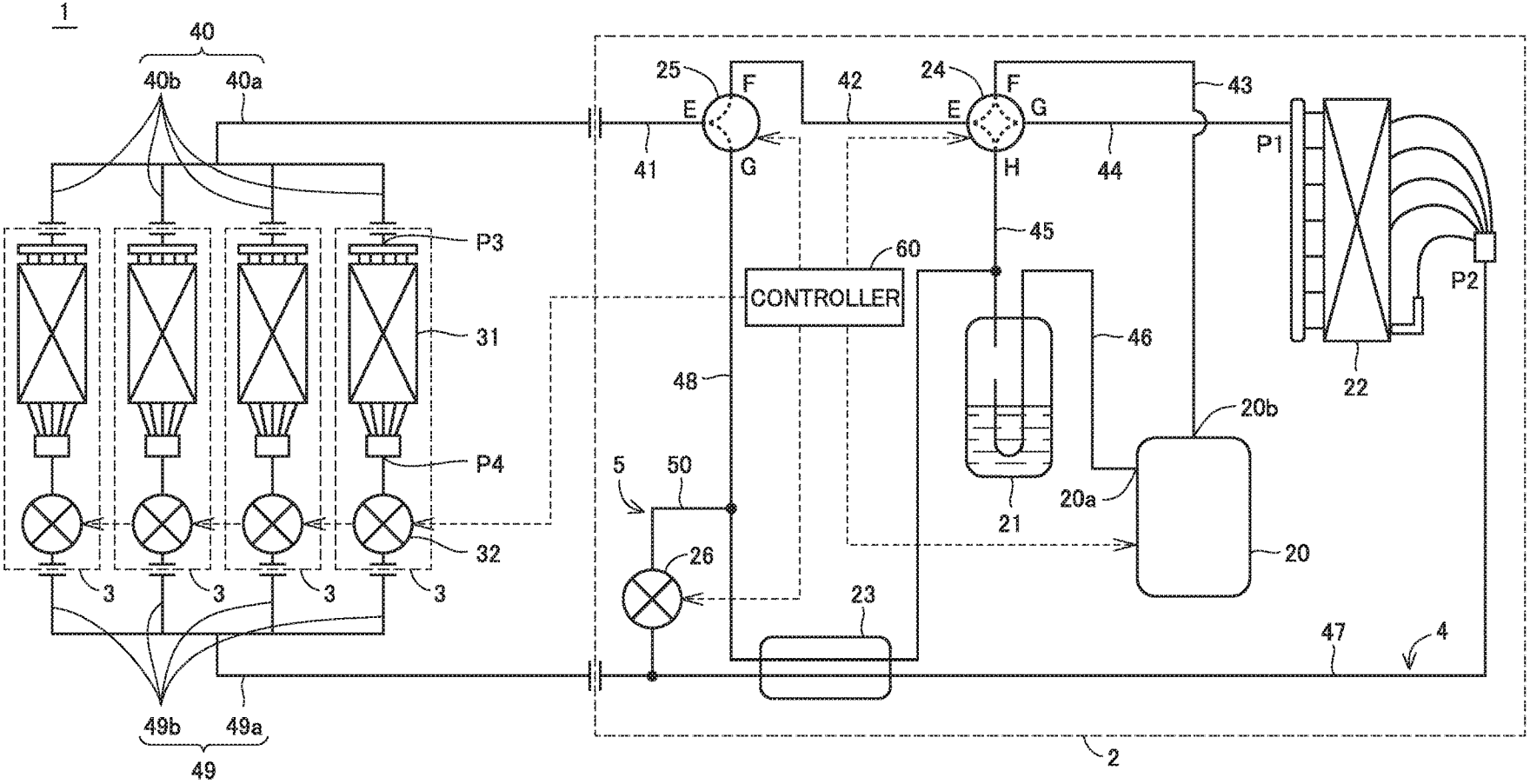
FIG. 1 shows an air conditioning apparatus according to an embodiment.

The following describes embodiments of the present disclosure with reference to figures in detail. In the description below, the plurality of embodiments will be described; however, it is initially expected at the time of filing of the present application to appropriately combine configurations described in the embodiments. It should be noted that the same or corresponding portions in the figures are given the same reference characters and are not described repeatedly.

FIG. 1 shows an air conditioning apparatus 1 according to an embodiment. With reference to FIG. 1, air conditioning apparatus 1 includes: an outdoor unit 2 including a compressor 20 and an outdoor heat exchanger 22; and a plurality of indoor units 3 each including an expansion valve 32 and an indoor heat exchanger 31. Compressor 20 is provided with a suction hole 20*a* configured to suction refrigerant, and a discharge hole 20*b* configured to discharge the refrigerant. Air conditioning apparatus 1 further includes a main circuit 4 configured to circulate the refrigerant through compressor 20, outdoor heat exchanger 22, expansion valve 32, and indoor heat exchanger 31.

Air conditioning apparatus 1 further includes an accumulator 21, a supercooling heat exchanger 23, a four-way valve 24, a flow path switching valve 25, a bypass regulating valve 26, and a bypass circuit 5 branched from main circuit 4 and returning to main circuit 4. In the present embodiment, accumulator 21, supercooling heat exchanger 23, four-way valve 24, flow path switching valve 25, bypass regulating valve 26, and bypass circuit 5 are disposed in outdoor unit 2. However, parts of these configurations may be disposed outside outdoor unit 2. Four-way valve 24 is provided with four ports E to H. Flow path switching valve 25 is a three-way valve, and is provided with three ports E to G.

Main circuit 4 includes: pipes 41 to 48 disposed in outdoor unit 2; and a gas pipe 40 and a liquid pipe 49 each connecting outdoor unit 2 to the plurality of indoor units 3. Main circuit 4 is changed in accordance with an operation mode. Bypass circuit 5 includes pipes 48, 50. Pipe 48 constitutes main circuit 4 in part of operation modes and constitutes bypass circuit 5 in the other operation mode.

Pipe (first pipe) 41 connects gas pipe 40 to port E of flow path switching valve 25. Pipe (second pipe) 42 connects port F of flow path switching valve 25 to port E of four-way valve 24. Pipe 43 connects port F of four-way valve 24 to discharge hole 20*b* of compressor 20. Pipe 44 connects port G of four-way valve 24 to port P1 of outdoor heat exchanger 22. Pipe 45 connects port H of four-way valve 24 to a refrigerant inlet of accumulator 21. Pipe 46 connects a refrigerant outlet of accumulator 21 to suction hole 20*a* of compressor 20. Pipe 47 connects a port P2 of outdoor heat exchanger 22 to liquid pipe 49, and extends through supercooling heat exchanger 23.

Pipe 48 connects port G of flow path switching valve 25 to a branch point of pipe 45, and extends through supercooling heat exchanger 23.

Pipe 50 connects a branch point of pipe 47 between supercooling heat exchanger 23 and liquid pipe 49 to a branch point of pipe 48 between port G of flow path switching valve 25 and supercooling heat exchanger 23. Bypass circuit 5 constituted of pipe 50 and part of pipe 48 is branched from pipe 47, exchanges heat with pipe 47 through supercooling heat exchanger 23, and is joined to pipe 45 included in main circuit 4.

Gas pipe 40 has: a gas main pipe 40*a* having one end connected to pipe 41 of outdoor unit 2; and a plurality of gas branch pipes 40*b* branched from the other end of gas main pipe 40*a*. The number of gas branch pipes 40*b* coincides with the number of indoor units 3. Each of gas branch pipes 40*b* connects gas main pipe 40*a* to a corresponding indoor unit 3. Gas main pipe 40*a* has an inner diameter larger than that of gas branch pipe 40*b*.

Liquid pipe 49 has: a liquid main pipe 49*a* having one end connected to pipe 47 of outdoor unit 2; and a plurality of liquid branch pipes 49*b* branched from the other end of liquid main pipe 49*a*. The number of liquid branch pipes 49*b* coincides with the number of indoor units 3. Each of liquid branch pipe 49*b* connects liquid main pipe 49*a* to a corresponding indoor unit 3. Liquid main pipe 49*a* has an inner diameter larger than that of liquid branch pipe 49*b*.

Each of the plurality of indoor units 3 includes indoor heat exchanger 31 and expansion valve 32. Port P3 of each indoor heat exchanger 31 is connected to a corresponding gas branch pipe 40*b*. Port P4 of each indoor heat exchanger 31 is connected to a corresponding liquid branch pipe 49*b* through expansion valve 32. It should be noted that expansion valve 32 may be provided at liquid branch pipe 49*b*.

Air conditioning apparatus 1 further includes a pressure sensor not shown in the figures, a temperature sensor not shown in the figures, and a controller 60. In the present embodiment, controller 60 is disposed in outdoor unit 2. However, controller 60 may be disposed outside outdoor unit 2.

Controller 60 includes a CPU (Central Processing Unit), a storage device, an input/output buffer, and the like (all not shown). In the case of the cooling operation, controller 60 determines whether or not a cooling load is lower than a reference. Specifically, controller 60 makes comparison between a reference value and a parameter correlated with a flow rate of the refrigerant in main circuit 4, determines that the load is low when the parameter indicates that the flow rate of the refrigerant is less than the reference value, and determines that the load is not low when the parameter indicates that the flow rate of the refrigerant is more than the reference value. In the present embodiment, as the parameter, controller 60 employs the number of indoor units 3 that are being operating among the plurality of indoor units 3. Controller 60 determines that the load is low when the number of indoor units 3 that are being operating is less than the reference value, and determines that the load is not low when the number of indoor units 3 that are being operating is more than the reference value.

Controller 60 controls compressor 20, four-way valve 24, expansion valve 32, flow path switching valve 25, and bypass regulating valve 26 in accordance with a result of the above determination, an operation instruction signal provided by a user, and outputs of various sensors. It should be noted that the control is not limited to a process by software, but can be performed by dedicated hardware (an electronic circuit).

Accumulator 21 separates liquid-phase refrigerant from the refrigerant flowing in pipe 45. Compressor 20 suctions, from suction hole 20*a*, gas-phase refrigerant having passed through accumulator 21, compresses the gas-phase refrigerant, and discharges the compressed refrigerant from discharge hole 20*b*. Compressor 20 is configured to change its operation frequency in accordance with a control signal received from controller 60. An output of compressor 20 is adjusted by changing the operation frequency of compressor 20. Specifically, compressor 20 is controlled to increase its operation frequency as an air conditioning load (cooling load or heating load) becomes higher. A higher air conditioning load means a higher flow rate of the refrigerant in main circuit 4. For compressor 20, various types of compressors can be employed, such as a rotary type compressor, a reciprocating type compressor, a scroll type compressor, and a screw type compressor.

Outdoor heat exchanger 22 exchanges heat between the refrigerant and the outdoor air. In the case of the cooling operation, outdoor heat exchanger 22 functions as a condenser. In the case of the heating operation, outdoor heat exchanger 22 functions as an evaporator.

Supercooling heat exchanger 23 supercools the refrigerant flowing in a first flow path of the main circuit 4 between outdoor heat exchanger 22 and expansion valve 32. Specifically, supercooling heat exchanger 23 supercools the refrigerant flowing in pipe 47, by exchanging heat between the high-pressure refrigerant flowing in pipe 47 included in the first flow path and the low-pressure refrigerant flowing in pipe 48.

Indoor heat exchanger 31 exchanges heat between the refrigerant and the indoor air. In the case of the cooling operation, indoor heat exchanger 31 functions as an evaporator. In the case of the heating operation, indoor heat exchanger 31 functions as a condenser.

In accordance with a control signal received from controller 60, four-way valve 24 is controlled to be brought into one of a cooling operation state and a heating operation state. In the cooling operation state, port E communicates with port H and port F communicates with port G. In the heating operation state, port E communicates with port F and port H communicates with port G. In other words, in the case of the cooling operation, four-way valve 24 communicates pipe 42 with suction hole 20*a* of compressor 20 through pipe 45, accumulator 21, and pipe 46, and communicates port P1 of outdoor heat exchanger 22 with discharge hole 20*b* of compressor 20 through pipes 44, 43. In the case of the heating operation, four-way valve 24 communicates pipe 42 with discharge hole 20*b* of compressor 20 through pipes 44, 43, and communicates port P1 of outdoor heat exchanger 22 with suction hole 20*a* of compressor 20 through pipe 45, accumulator 21, and pipe 46.

A degree of opening of expansion valve 32 is controlled in accordance with a control signal received from controller 60. For example, in the case of the cooling operation, the degree of opening of expansion valve 32 is controlled to cause a degree of superheat of the refrigerant at port P3 of indoor heat exchanger 31 to fall within an appropriate range.

Based on a control signal received from controller 60, flow path switching valve 25 switches the flow path between indoor heat exchanger 31 and compressor 20 to one of a second flow path that does not extend through supercooling heat exchanger 23 and a third flow path that extends through supercooling heat exchanger 23. In accordance with a control signal, flow path switching valve 25 is controlled to be brought into one of a first state and a second state. In the first state, port E communicates with port F and port G is closed. In the second state, port E communicates with port G and port F is closed. In other words, flow path switching valve 25 is configured to communicate pipe 41 with one of pipe 42 and pipe 48, and close the other of pipe 42 and pipe 48. By controlling flow path switching valve 25 to be brought into the first state, the flow path between indoor heat exchanger 31 and compressor 20 is switched to the second flow path that does not extend through supercooling heat exchanger 23. By controlling flow path switching valve 25 to be brought into the second state, the flow path between indoor heat exchanger 31 and compressor 20 is switched to the third flow path that extends through supercooling heat exchanger 23.

Bypass regulating valve 26 is provided at pipe 50 included in bypass circuit 5. Bypass regulating valve 26 is disposed at the upstream side relative to supercooling heat exchanger 23. Bypass regulating valve 26 is controlled to be brought into one of an open state and a close state in accordance with a control signal received from controller 60. Bypass regulating valve 26 is set to a degree of opening other than a fully open state, when controlled to be brought into the open state. By controlling bypass regulating valve 26 to be brought into the open state, the refrigerant branched from pipe 47 is decompressed by bypass regulating valve 26, and passes through supercooling heat exchanger 23. When bypass regulating valve 26 is controlled to be brought into the close state, bypass circuit 5 is closed.

FIG. 2 shows a relation between the operation mode of air conditioning apparatus 1 and each of the states of four-way valve 24, flow path switching valve 25, and bypass regulating valve 26. The operation mode includes: a first cooling operation mode, which is a cooling operation mode when the load is not low; a second cooling operation mode, which is a cooling operation mode when the load is low; and a heating operation mode. With reference to FIG. 2, four-way valve 24 is controlled to be in the cooling operation state during each of the first cooling operation mode and the second cooling operation mode, and is controlled to be in the heating operation state during the heating operation mode. During the first cooling operation mode, flow path switching valve 25 is controlled to be in the first state, and bypass regulating valve 26 is controlled to be in the open state. During the second cooling operation mode, flow path switching valve 25 is controlled to be in the second state, and bypass regulating valve 26 is controlled to be in the close state. During the heating operation mode, flow path switching valve 25 is controlled to be in the first state, and bypass regulating valve 26 is controlled to be in the close state.

Figure 3:
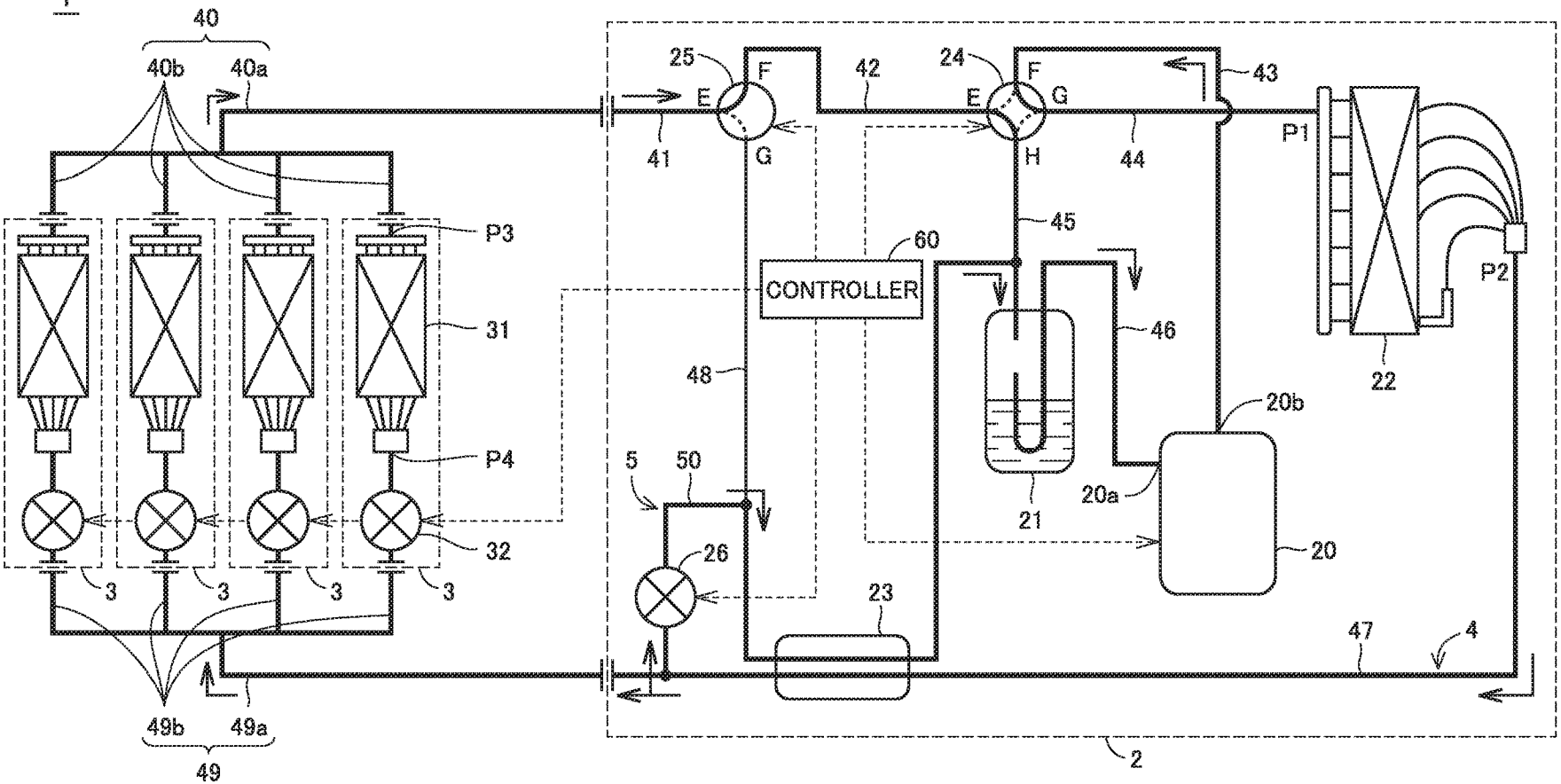
FIG. 3 shows a main circuit and a bypass circuit in a first cooling operation mode.

FIG. 3 shows main circuit 4 and bypass circuit 5 in the first cooling operation mode (cooling operation mode when the load is not low). With reference to FIG. 3, main circuit 4 in the first cooling operation mode is a circuit in which the refrigerant circulates through compressor 20, pipe 43, pipe 44, outdoor heat exchanger 22, pipe 47 (extending through supercooling heat exchanger 23), liquid pipe 49, expansion valves 32, indoor heat exchangers 31, gas pipe 40, pipe 41, pipe 42, pipe 45, accumulator 21, and pipe 46 in this order. In the first cooling operation mode, flow path switching valve 25 switches the flow path between indoor heat exchanger 31 and compressor 20 to the second flow path that does not extend through supercooling heat exchanger 23. The second flow path in the first cooling operation mode is a flow path that extends through gas pipe 40, pipe 41, pipe 42, pipe 45, accumulator 21, and pipe 46.

In the first cooling operation mode, bypass regulating valve 26 is controlled to be in the open state. Hence, bypass circuit 5 is constituted of pipe 50 and pipe 48. That is, in the first cooling operation mode, pipe 48 is included in bypass circuit 5. Accordingly, part of the refrigerant flowing in pipe 47 is branched from pipe 47, exchanges heat with the refrigerant flowing in pipe 47 through supercooling heat exchanger 23, and is joined to pipe 45 included in main circuit 4.

In the first refrigerant operation mode, compressor 20 suctions the refrigerant from pipe 46 and compresses the refrigerant. The compressed refrigerant flows into pipe 44 via pipe 43 and four-way valve 24. Outdoor heat exchanger 22 condenses the refrigerant flowing in pipe 44. Outdoor heat exchanger 22 is configured to exchange (dissipate) heat between outdoor air and the high-temperature high-pressure superheated vapor (refrigerant) discharged from compressor 20. With this heat exchange, the refrigerant is condensed and liquefied. The condensed refrigerant flows in pipe 47, exchanges heat, at supercooling heat exchanger 23, with the refrigerant flowing in pipe 48, and is supercooled. Part of the refrigerant having passed through supercooling heat exchanger 23 in pipe 47 passes through bypass circuit 5 constituted of pipe 50 and part of pipe 48, and is joined to pipe 45. The refrigerant flowing in pipe 50 is decompressed by bypass regulating valve 26. The decompressed refrigerant flows in pipe 48 and passes through supercooling heat exchanger 23. The refrigerant flowing in pipe 48 has a lower pressure and a lower temperature than those of the refrigerant flowing in pipe 47, and therefore draws heat from the refrigerant flowing in pipe 47. Accordingly, the refrigerant flowing in pipe 47 is supercooled.

The refrigerant having flowed from pipe 47 into liquid main pipe 49*a* flows to be branched to the plurality of liquid branch pipes 49*b*. In air conditioning apparatus 1 including the plurality of indoor units 3, the inner diameter and surface area of liquid main pipe 49*a* are large. Further, depending on installation locations of indoor units 3, liquid main pipe 49*a* and liquid branch pipes 49*b* become long. Accordingly, the refrigerant flowing in liquid pipe 49 absorbs heat to some extent from the external air through liquid pipe 49. An amount of absorbed heat while the refrigerant flows in liquid pipe 49 is associated with the flow rate of the refrigerant in liquid pipe 49. As the flow rate of the refrigerant is higher, it takes a shorter time for the refrigerant to pass through liquid pipe 49, with the result that the amount of absorbed heat is decreased.

Expansion valve 32 decompresses the refrigerant flowing in liquid branch pipe 49*b*. Indoor heat exchanger 31 evaporates the refrigerant having passed through expansion valve 32. Indoor heat exchanger 31 is configured such that the refrigerant decompressed by expansion valve 32 exchanges (absorbs) heat with the indoor air to evaporate. The evaporated refrigerant flows into outdoor unit 2 via gas pipe 40.

The refrigerant having flowed into outdoor unit 2 reaches compressor 20 via pipe 41, flow path switching valve 25, pipe 42, four-way valve 24, pipe 45, accumulator 21 and pipe 46.

As such, in the first cooling operation mode, supercooling heat exchanger 23 exchanges heat between the refrigerant flowing in pipe 47 and the refrigerant flowing in bypass circuit 5 branched from pipe 47, thereby supercooling the refrigerant flowing in pipe 47. Since the load is not low, the flow rate of the refrigerant in liquid pipe 49 is secured to some extent, thus resulting in a small amount of absorbed heat in the refrigerant flowing in liquid pipe 49. Accordingly, an amount of gas phase in the refrigerant at the inlet of expansion valve 32 is decreased, thereby suppressing a refrigerant sound generated from expansion valve 32.

Further, since the flow path between indoor heat exchanger 31 and compressor 20 is switched to the second flow path that does not extend through supercooling heat exchanger 23, pressure loss in the flow path between indoor heat exchanger 31 and compressor 20 can be suppressed from being increased.

Figure 4:
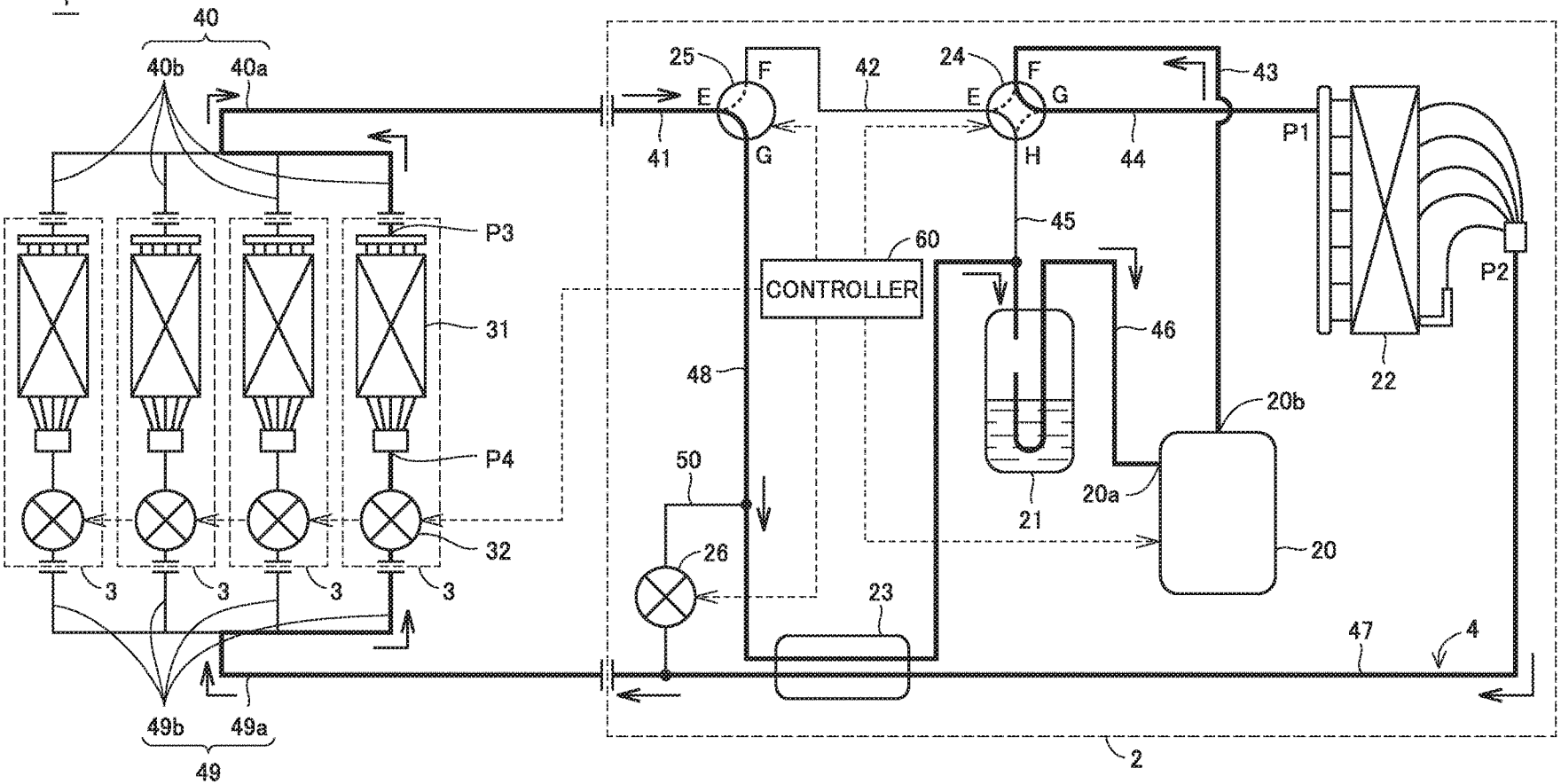
FIG. 4 shows a main circuit in a second cooling operation mode.

FIG. 4 shows main circuit 4 in the second cooling operation mode (cooling operation mode when the load is low). FIG. 4 shows a case where only one of the plurality of indoor units 3 is being operating. With reference to FIG. 4, main circuit 4 in the second cooling operation mode is a circuit in which the refrigerant circulates through compressor 20, pipe 43, pipe 44, outdoor heat exchanger 22, pipe 47 (extending through supercooling heat exchanger 23), liquid pipe 49, expansion valve 32, indoor heat exchanger 31, gas pipe 40, pipe 41, pipe 48, pipe 45, accumulator 21, and pipe 46 in this order. In the second cooling operation mode, flow path switching valve 25 switches the flow path between indoor heat exchanger 31 and compressor 20 to the third flow path that extends through supercooling heat exchanger 23 to exchange heat with pipe 47. The third flow path in the second cooling operation mode is a flow path that extends through gas pipe 40, pipe 41, pipe 48, pipe 45, accumulator 21, and pipe 46. In the second cooling operation mode, pipe 48 is included in main circuit 4.

The flow path from compressor 20 to pipe 47 in the second cooling operation mode is the same as the flow path shown in FIG. 3 from compressor 20 to pipe 47 in the first refrigerant operation mode. Hence, the flow path from compressor 20 to pipe 47 is not described in detail. Since bypass regulating valve 26 is controlled to be in the close state, a whole of the refrigerant supercooled by supercooling heat exchanger 23 flows into liquid main pipe 49*a*. Since expansion valves 32 of indoor units 3 that are not being operating are closed, the refrigerant flowing in liquid main pipe 49*a* passes through liquid branch pipe 49*b* corresponding to indoor unit 3 that is being operating, and is decompressed by expansion valve 32. Indoor heat exchanger 31 evaporates the refrigerant having passed through expansion valve 32. The evaporated refrigerant flows into outdoor unit 2 via gas pipe 40.

The refrigerant having flowed into outdoor unit 2 flows into the accumulator via pipe 41, flow path switching valve 25, pipe 48 and pipe 45. Supercooling heat exchanger 23 exchanges heat between the high-temperature high-pressure refrigerant flowing in pipe 47 and the low-temperature low-pressure refrigerant flowing in pipe 48, thereby supercooling the refrigerant flowing in pipe 47. Although the whole of the refrigerant having passed through indoor heat exchanger 31 passes through supercooling heat exchanger 23, the flow rate of the refrigerant in main circuit 4 is small in the first place because the load is low. Accordingly, pressure loss in the flow path between indoor heat exchanger 31 and compressor 20 is suppressed from being increased.

Since bypass regulating valve 26 is controlled to be in the close state, the whole of the refrigerant flowing in pipe 47 flows in liquid pipe 49. Accordingly, the flow rate of the refrigerant in liquid pipe 49 can be avoided from being decreased extremely, whereby the amount of absorbed heat in the refrigerant passing through liquid pipe 49 can be suppressed from being increased. As a result, the amount of gas phase in the refrigerant at the inlet of expansion valve 32 is reduced, whereby a refrigerant sound generated from expansion valve 32 can be suppressed.

Further, the refrigerant having passed through gas pipe 40 absorbs heat in supercooling heat exchanger 23. Accordingly, even if the refrigerant flowing in gas pipe 40 is in a two-phase coexistence state, the refrigerant flowing in pipe 48 at the downstream side relative to supercooling heat exchanger 23 can be brought into the gas phase state. As a result, liquid back, which causes the liquid-phase refrigerant to flow into compressor 20, can be suppressed. Moreover, with the refrigerant at the outlet of indoor heat exchanger 31 being in the two-phase coexistence state, an uneven temperature distribution of indoor heat exchanger 31 can be reduced. As a result, dews resulting from the uneven temperature distribution in indoor heat exchanger 31 can be suppressed from falling down.

Figure 5:
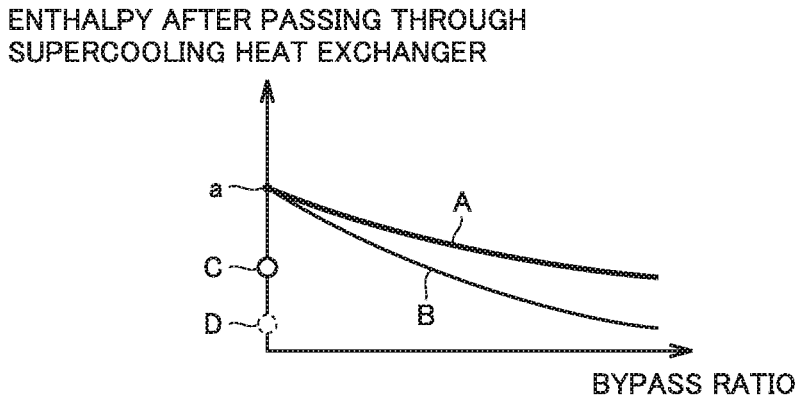
FIG. 5 is a graph showing an enthalpy of refrigerant just after passing through a supercooling heat exchanger in a first flow path during a cooling operation.

FIG. 5 is a graph showing an enthalpy of the refrigerant just after passing through supercooling heat exchanger 23 in pipe 47 included in the first flow path during the cooling operation. In the graph shown in FIG. 5, the horizontal axis represents a ratio (hereinafter, referred to as "by-pass ratio") of the flow rate of the refrigerant passing through bypass regulating valve 26 with respect to the flow rate of the whole of the refrigerant in main circuit 4, and the vertical axis represents an enthalpy of the refrigerant just after passing through supercooling heat exchanger 23 in pipe 47.

Figure 6:
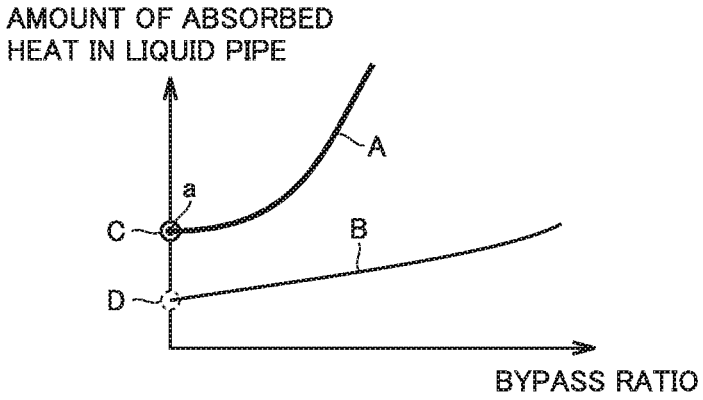
FIG. 6 is a graph showing an amount of absorbed heat when the refrigerant flows in a liquid pipe during the cooling operation.

FIG. 6 is a graph showing the amount of absorbed heat when the refrigerant flows in liquid pipe 49 during the cooling operation. In the graph shown in FIG. 6, the horizontal axis represents the by-pass ratio and the vertical axis represents the amount of absorbed heat when the refrigerant flows in liquid pipe 49.

Figure 7:
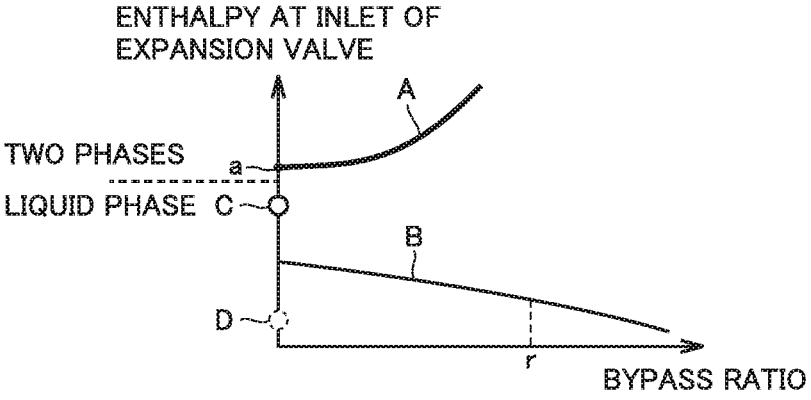
FIG. 7 is a graph showing an enthalpy of the refrigerant at an inlet of an expansion valve during the cooling operation.

FIG. 7 is a graph showing an enthalpy of the refrigerant at the inlet of expansion valve 32 during the cooling operation. In the graph shown in FIG. 7, the horizontal axis represents the by-pass ratio and the vertical axis represents the enthalpy of the refrigerant at the inlet of expansion valve 32.

In the graphs shown in FIGS. 5 and 7, each of lines A, B represents a change of the enthalpy with respect to the by-pass ratio when flow path switching valve 25 is in the first state and bypass regulating valve 26 is in the open state. Line A represents a change of the enthalpy when the load is low, and line B represents a change of the enthalpy when the load is not low. Each of circles C, D represents the enthalpy when flow path switching valve 25 is in the second state and bypass regulating valve 26 is in the close state. Circle C represents the enthalpy when the load is low, and circle D represents the enthalpy when the load is not low.

Likewise, in the graph shown in FIG. 6, each of lines A, B represents a change of the amount of absorbed heat with respect to the by-pass ratio when flow path switching valve 25 is in the first state and bypass regulating valve 26 is in the open state. Line A represents a change of the amount of absorbed heat when the load is low, and line B represents a change of the amount of absorbed heat when the load is not low. Each of circles C, D represents the amount of absorbed heat when flow path switching valve 25 is in the second state and bypass regulating valve 26 is in the close state. Circle C represents the amount of absorbed heat when the load is low, and circle D represents the amount of absorbed heat when the load is not low.

As indicated by lines A and B of FIG. 5, as the by-pass ratio becomes larger, the enthalpy of the refrigerant just after passing through supercooling heat exchanger 23 in pipe 47 is decreased. This is due to the following reason: as the by-pass ratio becomes larger, the flow rate of the refrigerant in pipe 48 is increased, with the result that the amount of exchanged heat in supercooling heat exchanger 23 is increased.

Further, the enthalpy (line B and circle D) of the refrigerant just after passing through supercooling heat exchanger 23 in pipe 47 when the load is not low is smaller than the enthalpy (line A and circle C) of the refrigerant just after passing through supercooling heat exchanger 23 in pipe 47 when the load is low. This is due to the following reason: since the flow rate of the whole of the refrigerant in main circuit 4 when the load is not low is larger than the flow rate of the whole of the refrigerant therein when the load is low, the flow rate of the refrigerant in pipe 48 when the load is not low becomes more than the flow rate of the refrigerant in pipe 48 when the load is low.

As indicated by line A of FIG. 6, as the by-pass ratio becomes larger, the amount of absorbed heat when the refrigerant flows in liquid pipe 49 is increased rapidly. This is due to the following reason: since the flow rate of the refrigerant in main circuit 4 is small in the first place when the load is low and the refrigerant is branched from pipe 47 to flow into pipe 50, the flow rate of the refrigerant in liquid pipe 49 is decreased extremely. When the flow rate of the refrigerant in liquid pipe 49 is decreased extremely, it takes a long time for the refrigerant to pass through liquid pipe 49, with the result that the amount of absorbed heat is increased rapidly. On the other hand, when the load is not low, the flow rate of the refrigerant in main circuit 4 is high. Hence, even when the by-pass ratio becomes large, the flow rate of the refrigerant in liquid pipe 49 can be secured to some extent. Hence, the inclination of line B is smaller than the inclination of line A. The inclination of each of lines A and B represents the inclination of an amount of increase in the amount of absorbed heat with respect to an amount of increase in the by-pass ratio.

The amounts of absorbed heat at circles C and D of FIG. 6 respectively coincide with the amounts of absorbed heat when the refrigerant flows in liquid pipe 49 with the by-pass ratio being 0 at lines A and B.

The enthalpy of the refrigerant at the inlet of expansion valve 32 is correlated with a total of the enthalpy of the refrigerant just after passing through supercooling heat exchanger 23 in pipe 47 and the amount of absorbed heat when the refrigerant flows in liquid pipe 49.

In each of FIGS. 5 to 7, a point a at which the by-pass ratio is 0 in line A represents a value when no refrigerant flows in pipe 48 extending through supercooling heat exchanger 23. That is, the refrigerant condensed by outdoor heat exchanger 22 is not supercooled by supercooling heat exchanger 23, and reaches expansion valve 32. When the load is low, even if the refrigerant just after passing through supercooling heat exchanger 23 in pipe 47 is in the liquid phase, the refrigerant at the inlet of expansion valve 32 is in the two-phase state in which the gas phase and the liquid phase coexist, because the amount of absorbed heat when the refrigerant flows in liquid pipe 49 is large (see point a in FIG. 7). Further, as indicated by line A of FIG. 6, when the load is low, as the by-pass ratio becomes larger, the amount of absorbed heat when the refrigerant flows in liquid pipe 49 is increased rapidly. Hence, as indicated by line A of FIG. 7, when the load is low, as the by-pass ratio becomes larger, the enthalpy of the refrigerant at the inlet of expansion valve 32 is increased rapidly.

On the other hand, the enthalpy at circle C of FIG. 7 is smaller than the enthalpy at line A. This indicates that the refrigerant is in the liquid phase. This is due to the following reason: the amount of absorbed heat at circle C of FIG. 6 is the same as the amount of absorbed heat at point a, but the entropy at circle C of FIG. 5 is smaller than the enthalpy at point a of FIG. 5. Therefore, when the load is low, in order to reduce introduction of the gas phase at the inlet of expansion valve 32 to suppress a refrigerant sound generated from expansion valve 32, flow path switching valve 25 is preferably controlled to be in the second state and bypass regulating valve 26 is preferably controlled to be in the close state.

As shown in FIG. 7, at any by-pass ratio, line B represents an enthalpy smaller than those at line A and circle C. This is due to the following reason: as shown in FIG. 6, the amount of absorbed heat (line B) when the load is not low and the refrigerant flows in liquid pipe 49 is smaller than the amount of absorbed heat (line A) when the load is low and the refrigerant flows in liquid pipe 49. Moreover, the absolute value of the inclination of line B in FIG. 5 is more than the absolute value of the inclination of line B of FIG. 6. Accordingly, when the load is not low, as indicated by line B of FIG. 7, as the by-pass ratio becomes larger, the enthalpy of the refrigerant at the inlet of expansion valve 32 is decreased. Moreover, the enthalpy at circle D of FIG. 7 becomes smaller than the enthalpy at line B. In view of the above, in the case where the load is not low, introduction of the gas phase at the inlet of expansion valve 32 can be reduced even when flow path switching valve 25 is controlled to be in the first state and bypass regulating valve 26 is controlled to be in the open state, or even when flow path switching valve 25 is controlled to be in the second state and bypass regulating valve 26 is controlled to be in the close state. Accordingly, a refrigerant sound generated from the expansion valve can be suppressed.

Figure 8:
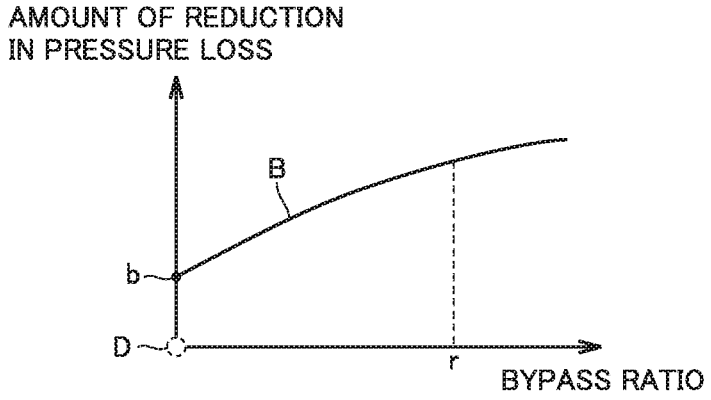
FIG. 8 is a graph showing an amount of reduction of pressure loss in a flow path between the indoor heat exchanger and the compressor in the cooling operation when a load is not low.

FIG. 8 is a graph showing an amount of reduction of pressure loss in the flow path between indoor heat exchanger 31 and compressor 20 during the cooling operation when the load is not low. In FIG. 8, the horizontal axis represents the by-pass ratio, and the vertical axis represents the amount of reduction of the pressure loss from a reference. Here, the reference of the amount of reduction of pressure loss, which is represented by circle D, is pressure loss in the flow path between indoor heat exchanger 31 and compressor 20 when the load is not low and when flow path switching valve 25 is controlled to be in the second state and bypass regulating valve 26 is controlled to be in the close state. Line B represents a change in the amount of reduction of the pressure loss with respect to the by-pass ratio when the load is not low and when flow path switching valve 25 is controlled to be in the first state and bypass regulating valve 26 is controlled to be in the open state.

As shown in FIG. 8, in the case where the load is not low, even when the by-pass ratio is 0, the pressure loss in the flow path between indoor heat exchanger 31 and compressor 20 can be reduced by bringing flow path switching valve 25 into the first state (see point b). This is because the flow path does not extend through supercooling heat exchanger 23. By increasing the by-pass ratio, the flow rate of the refrigerant in indoor heat exchanger 31 is decreased, whereby the pressure loss of the flow path between indoor heat exchanger 31 and compressor 20 can be further reduced.

As such, in the case where the load is not low, flow path switching valve 25 is preferably controlled to be in the first state and bypass regulating valve 26 is preferably controlled to be in the open state in order to suppress pressure loss of the flow path between indoor heat exchanger 31 and compressor 20, The by-pass ratio is set such that the enthalpy (see line B of FIG. 7) at the inlet of expansion valve 32 and the amount of reduction of pressure loss (see line B of FIG. 8) fall within appropriate ranges. In the present embodiment, the by-pass ratio is set to a by-pass ratio r shown in each of FIGS. 7 and 8.

It should be noted that since the flow rate of the refrigerant in indoor heat exchanger 31 is small in the first place in the case where the load is low, a difference in the pressure loss of the flow path between indoor heat exchanger 31 and compressor 20 is not large between the case where flow path switching valve 25 is controlled to be in the first state and the case where flow path switching valve 25 is controlled to be in the second state.

As described above, in order to suppress a refrigerant sound generated from expansion valve 32 during the cooling operation in the case where the load is low, it is preferable to close bypass regulating valve 26. On this occasion, flow path switching valve 25 needs to be in the second state in order to supercool the refrigerant in pipe 47 at supercooling heat exchanger 23. Hence, when the load is low, switching is made to main circuit 4 shown in FIG. 4.

On the other hand, in order to suppress pressure loss in the flow path between indoor heat exchanger 31 and compressor 20 during the cooling operation in the case where the load is not low, it is preferable to control flow path switching valve 25 to be in the first state. On this occasion, bypass regulating valve 26 needs to be in the open state in order to supercool the refrigerant in pipe 47 at supercooling heat exchanger 23. Accordingly, when the load is not low, switching is made to main circuit 4 and bypass circuit 5 shown in FIG. 3.

Figure 9:
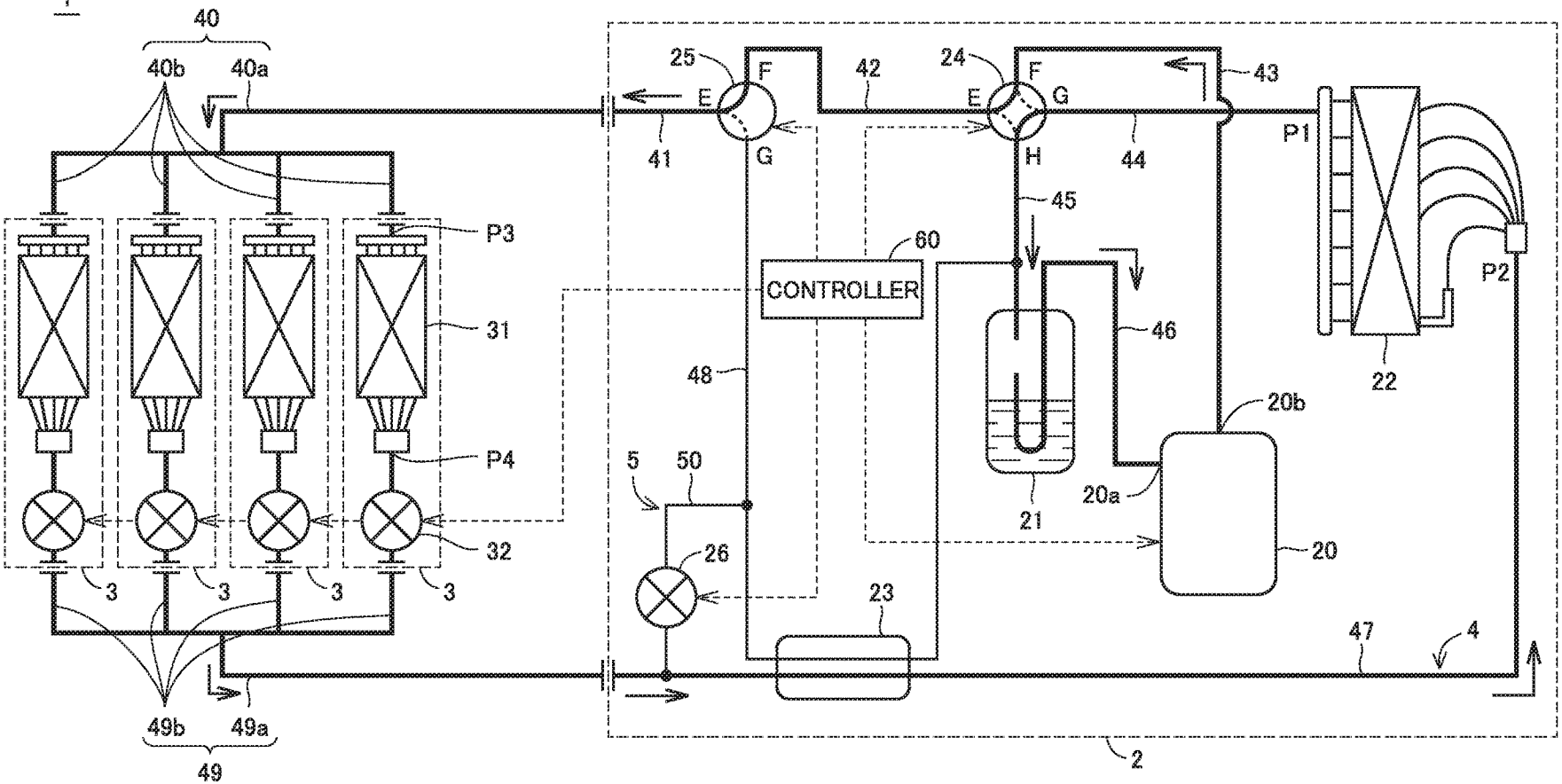
FIG. 9 shows the main circuit and the bypass circuit in a heating operation mode.

FIG. 9 shows main circuit 4 and bypass circuit 5 in the heating operation mode. With reference to FIG. 9, main circuit 4 in the heating operation mode is a circuit in which the refrigerant circulates through compressor 20, pipe 43, pipe 42, pipe 41, gas pipe 40, indoor heat exchangers 31, expansion valves 32, liquid pipe 49, pipe 47, outdoor heat exchanger 22, pipe 44, pipe 45, accumulator 21, and pipe 46 in this order. In the heating operation mode, flow path switching valve 25 switches the flow path between indoor heat exchanger 31 and compressor 20 to the second flow path that does not extend through supercooling heat exchanger 23. The second flow path in the heating operation mode is a flow path that extends through pipe 43, pipe 42, pipe 41, and gas pipe 40.

In the heating operation mode, bypass regulating valve 26 is controlled to be in the close state as with the first cooling operation mode. In the heating operation mode, no heat exchange is performed in supercooling heat exchanger 23.

In the heating operation mode, compressor 20 suctions the refrigerant from pipe 46 and compresses the refrigerant. The compressed refrigerant flows into pipe 42 via pipe 43 and four-way valve 24. Since flow path switching valve 25 is controlled to be in the first state, the refrigerant flowing in pipe 42 reaches each of indoor heat exchangers 31 (condensers) via flow path switching valve 25, pipe 41, and gas pipe 40. Indoor heat exchanger 31 condenses the refrigerant. The refrigerant condensed by indoor heat exchanger 31 is decompressed by expansion valve 32, and flows into pipe 47 of outdoor unit 2 via liquid pipe 49.

Generally, the flow rate of the refrigerant in main circuit 4 in the heating operation is smaller than that in the cooling operation and an excess of refrigerant is accumulated in accumulator 21. Accordingly, irrespective of a magnitude of the heating load, pressure loss in the flow path from compressor 20 to indoor heat exchanger 31 can be suppressed from being increased.

Moreover, in the heating operation, indoor heat exchanger 31 functions as a condenser. Since a distance from the outlet (here, port P4) of indoor heat exchanger 31 to expansion valve 32 is short, the amount of absorbed heat in the refrigerant having passed along the distance can be ignored. Therefore, by exchanging heat in indoor heat exchanger 31 such that the refrigerant satisfies a certain degree of supercooling at port P4 of indoor heat exchanger 31, introduction of the gas phase at the inlet of expansion valve 32 can be reduced. As a result, a refrigerant sound generated from expansion valve 32 can be suppressed.

Modification

In the description above, controller 60 determines whether or not the load is low based on whether or not the number of indoor units 3 that is being operating among the plurality of indoor units 3 is larger than the reference value. However, controller 60 may employ another parameter correlated with the flow rate of the refrigerant in main circuit 4 to determine whether or not the cooling load is lower than a reference. For example, controller 60 may compare an operation frequency of compressor 20 with a reference value, may determine that the load is low when the operation frequency is smaller than the reference value, and may determine that the load is not low when the operation frequency is larger than the reference value.

As four-way valve 24, a differential pressure driving type four-way valve can be used. The differential pressure driving type four-way valve is configured to switch between the cooling operation state and the heating operation state based on a differential pressure between suction hole 20*a* and discharge hole 20*b* of compressor 20. The differential pressure driving type four-way valve includes: a main body in which a valve chamber is formed; a pair of pistons slidable in the valve chamber; and a valve body fixed between the pair of pistons. By moving the pair of pistons in accordance with the differential pressure between suction hole 20*a* and discharge hole 20*b* of compressor 20, the flow path of the refrigerant is switched. In the case where the differential pressure driving type four-way valve is used, if the differential pressure is insufficient between suction hole 20*a* and discharge hole 20*b* when switching from the cooling operation to the heating operation, the valve body may not be moved completely and may be stopped at some point. Therefore, when switching from the cooling operation to the heating operation, controller 60 controls flow path switching valve 25 to be brought into the second state and then into the first state. In other words, controller 60 controls flow path switching valve 25 to communicate pipe 41 with pipe 48 and then communicate pipe 41 with pipe 42. When flow path switching valve 25 is in the second state, the refrigerant discharged by compressor 20 remains in pipe 43 and pipe 42. Accordingly, the differential pressure between suction hole 20*a* and discharge hole 20*b* of compressor 20 becomes large, whereby the differential pressure driving type four-way valve can be normally switched to the heating operation state. Further, controller 60 may control expansion valve 32 and bypass regulating valve 26 to be in the close state while flow path switching valve 25 is controlled to be in the second state. Accordingly, the pressure at suction hole 20*a* of compressor 20 is decreased, whereby the differential pressure between suction hole 20*a* and discharge hole 20*b* of compressor 20 can be further increased.

Flow path switching valve 25 may be constituted of two open/close valves. In this case, one open/close valve is disposed between pipe 41 and pipe 42, and the other open/close valve is disposed between pipe 41 and pipe 48. Accordingly, cost can be reduced as compared with a case where flow path switching valve 25 is constituted of a three-way valve. The refrigerant flows from pipe 41 to pipe 48 only during the cooling operation when the load is low. Accordingly, a valve having a smaller diameter than that of the open/close valve disposed between pipe 41 and pipe 42 is applicable to the open/close valve disposed between pipe 41 and pipe 48. As a result, cost for flow path switching valve 25 can be further reduced.

In the description above, the branch point of pipe 47 to which pipe 50 is connected is located between supercooling heat exchanger 23 and liquid pipe 49. However, the branch point of pipe 47 to which pipe 50 is connected may be located between outdoor heat exchanger 22 and supercooling heat exchanger 23.

Although FIG. 1 shows an embodiment in which the number of indoor units 3 is 4, the number of indoor units 3 is not limited. The number of the indoor units may be 1 to 3, or may be 5 or more.

Finally, the present embodiment will be summarized again with reference to figures. With reference to FIG. 1, an air conditioning apparatus 1 includes: an outdoor unit 2 including a compressor 20 and an outdoor heat exchanger 22; at least one indoor unit 3 including an expansion valve 32 and an indoor heat exchanger 31; and a main circuit 4 configured to circulate refrigerant through compressor 20, outdoor heat exchanger 22, expansion valve 32, and indoor heat exchanger 31. Main circuit 4 includes a first flow path between outdoor heat exchanger 22 and expansion valve 32. Air conditioning apparatus 1 further includes a supercooling heat exchanger 23 configured to supercool the refrigerant flowing in the first flow path. As a flow path between indoor heat exchanger 31 and compressor 20, main circuit 4 includes a second flow path that does not extend through supercooling heat exchanger 23, and a third flow path that extends through supercooling heat exchanger 23.

Air conditioning apparatus 1 further includes a flow path switching valve 25, a bypass circuit 5, a bypass regulating valve 26, and a controller 60. Flow path switching valve 25 is configured to switch, to one of the second flow path and the third flow path, the flow path between indoor heat exchanger 31 and compressor 20. Bypass circuit 5 is branched from the first flow path, extends through supercooling heat exchanger 23, and is joined to main circuit 4. Bypass regulating valve 26 is provided in bypass circuit 5. The controller is configured to control flow path switching valve 25 and bypass regulating valve 26. In a cooling operation, when a parameter correlated with a flow rate of the refrigerant in main circuit 4 indicates that the flow rate of the refrigerant is more than a reference value, controller 60 is configured to control flow path switching valve 25 to switch, to the second flow path, the flow path between indoor heat exchanger 31 and compressor 20, and open bypass regulating valve 26. In the cooling operation, when the parameter indicates that the flow rate of the refrigerant is less than the reference value, controller 60 is configured to control flow path switching valve 25 to switch, to the third flow path, the flow path between indoor heat exchanger 31 and compressor 20, and close bypass regulating valve 26.

According to the above-described configuration, since bypass regulating valve 26 is closed in the case where the load is low, the flow rate of the refrigerant in the first flow path can be suppressed from being too small. Accordingly, the amount of absorbed heat in the refrigerant between supercooling heat exchanger 23 and expansion valve 32 can be suppressed, whereby the amount of gas phase at the inlet of expansion valve 32 can be reduced. As a result, even when the load is low, a refrigerant sound generated from expansion valve 32 can be suppressed. Further, the control of air conditioning apparatus 1 become stable. It should be noted that since the flow rate of the refrigerant in main circuit 4 is small in the case where the load is low, the pressure loss in the flow path between indoor heat exchanger 31 and compressor 20 can be suppressed from being increased.

Further, in the case where the load is not low, the flow path between indoor heat exchanger 31 and compressor 20 is switched to the second flow path that does not extend through supercooling heat exchanger 23. Accordingly, the pressure loss in the flow path between indoor heat exchanger 31 and compressor 20 can be suppressed from being increased. As a result, the size of supercooling heat exchanger 23 does not need to be increased, and the cost for supercooling heat exchanger 23 can be reduced to be low. Furthermore, the efficiency of air conditioning apparatus 1 is improved. It should be noted that in the case where the load is not low, by opening bypass regulating valve 26, the refrigerant flowing in bypass circuit 5 exchanges heat with the refrigerant flowing in the first flow path, whereby the refrigerant flowing in the first flow path can be supercooled. Accordingly, the amount of gas phase at the inlet of expansion valve 32 can be reduced, and the refrigerant sound generated from expansion valve 32 can be suppressed.

As described above, it is possible to provide an air conditioning apparatus that can suppress increase of pressure loss between an indoor heat exchanger and a compressor and that can suppress generation of a refrigerant sound in an expansion valve. Further, such an effect is exhibited by simple components such as flow path switching valve 25, bypass regulating valve 26 and the pipes, whereby manufacturing cost of air conditioning apparatus 1 can be also suppressed from being increased.

The parameter may be an operation frequency of compressor 20. Alternatively air conditioning apparatus 1 may include a plurality of indoor units 3, and the parameter may be the number of indoor units 3 that are being operating among the plurality of indoor units 3.

Compressor 20 is provided with a suction hole **20*a* configured to suction the refrigerant, and a discharge hole 20*b* configured to discharge the refrigerant. Main circuit 4 includes: a pipe (first pipe) 41 configured to communicate with indoor heat exchanger 31; a pipe (second pipe) 42 configured not to extend through supercooling heat exchanger 23; and a pipe (third pipe) 48 configured to extend through supercooling heat exchanger 23 and communicate with suction hole 20*a*. Outdoor unit 2 further includes a four-way valve 24 configured to communicate pipe 42 with suction hole 20*a* and communicate outdoor heat exchanger 22 with discharge hole 20*b* in the cooling operation, and configured to communicate pipe 42 with discharge hole 20*b* and communicate outdoor heat exchanger 22 with suction hole 20*a* in a heating operation. Four-way valve 24 is driven by a differential pressure between suction hole 20*a* and discharge hole 20*b*. Flow path switching valve 25 is configured to communicate pipe 41 with one of pipe 42 and pipe 48 and close the other of pipe 42 and pipe 48. The second flow path is formed by communicating pipe 41 with pipe 42. The third flow path is formed by communicating pipe 41 with pipe 48. Controller 60 is configured to control flow path switching valve 25 to communicate pipe 41 with pipe 48 and then communicate pipe 41 with pipe 42**, when switching from the cooling operation to the heating operation.

According to the above-described configuration, when switching from the cooling operation to the heating operation, pipe 41 is temporarily communicated with pipe 48. On this occasion, pipe 42 is closed. Accordingly, the refrigerant compressed by compressor 20 remains in pipe 42. This leads to a large differential pressure between suction hole **20*a* and discharge hole 20*b* of compressor 20, whereby four-way valve 24** can be operated normally.

The embodiments disclosed herein are illustrative and non-restrictive in any respect. The scope of the present invention is defined by the terms of the claims, rather than the embodiments described above, and is intended to include any modifications within the scope and meaning equivalent to the terms of the claims.

REFERENCE SIGNS LIST

1: air conditioning apparatus; 2: outdoor unit; 3: indoor unit; 4: main circuit; 5: bypass circuit; 20: compressor; **20*a*: suction hole; 20*b*: discharge hole; 21: accumulator; 22: outdoor heat exchanger; 23: supercooling heat exchanger; 24: four-way valve; 25: flow path switching valve; 26: bypass regulating valve; 31: indoor heat exchanger; 32: expansion valve; 40: gas pipe; 40*a*: gas main pipe; 40*b*: gas branch pipe; 41 to 48, 50: pipe; 49: liquid pipe; 49*a*: liquid main pipe; 49*b*: liquid branch pipe; 60**: controller.

The invention claimed is:

1. An air conditioning apparatus comprising:

an outdoor unit including a compressor and an outdoor heat exchanger;

at least one indoor unit including an expansion valve and an indoor heat exchanger; and a main circuit configured to circulate refrigerant through the compressor, the outdoor heat exchanger, the expansion valve, and the indoor heat exchanger, wherein the main circuit includes a first flow path between the outdoor heat exchanger and the expansion valve, the air conditioning apparatus further comprising a supercooling heat exchanger configured to supercool the refrigerant flowing in the first flow path, wherein as a flow path between the indoor heat exchanger and the compressor, the main circuit includes a second flow path that does not extend through the supercooling heat exchanger, and a third flow path that extends through the supercooling heat exchanger, the air conditioning apparatus further comprising:

a flow path switching valve configured to switch, to one of the second flow path and the third flow path, the flow path between the indoor heat exchanger and the compressor;

a bypass circuit that is branched from the first flow path, that extends through the supercooling heat exchanger, and that is joined to the main circuit;

a bypass regulating valve provided in the bypass circuit; and a controller configured to control the flow path switching valve and the bypass regulating valve, wherein in a cooling operation, when a parameter correlated with a flow rate of the refrigerant in the main circuit indicates that the flow rate of the refrigerant is more than a reference value, the controller is configured to control the flow path switching valve to switch, to the second flow path, the flow path between the indoor heat exchanger and the compressor, and open the bypass regulating valve, and when the parameter indicates that the flow rate of the refrigerant is less than the reference value, the controller is configured to control the flow path switching valve to switch, to the third flow path, the flow path between the indoor heat exchanger and the compressor, and close the bypass regulating valve.

2. The air conditioning apparatus according to claim 1, wherein the compressor is provided with a suction hole configured to suction the refrigerant, and a discharge hole configured to discharge the refrigerant, the main circuit includes a first pipe configured to communicate with the indoor heat exchanger, a second pipe configured not to extend through the supercooling heat exchanger, and a third pipe configured to extend through the supercooling heat exchanger and communicate with the suction hole, the outdoor unit further includes a four-way valve configured to communicate the second pipe with the suction hole and communicate the outdoor heat exchanger with the discharge hole in the cooling operation, and configured to communicate the second pipe with the discharge hole and communicate the outdoor heat exchanger with the suction hole in a heating operation, the four-way valve is driven by a differential pressure between the suction hole and the discharge hole, the flow path switching valve is configured to communicate the first pipe with one of the second pipe and the third pipe and close the other of the second pipe and the third pipe, the second flow path is formed by communicating the first pipe with the second pipe, the third flow path is formed by communicating the first pipe with the third pipe, and the controller is configured to control the flow path switching valve to communicate the first pipe with the third pipe and then communicate the first pipe with the second pipe, when switching from the cooling operation to the heating operation.

3. The air conditioning apparatus according to claim 1, wherein the parameter is an operation frequency of the compressor.

4. The air conditioning apparatus according to claim 3, wherein the compressor is provided with a suction hole configured to suction the refrigerant, and a discharge hole configured to discharge the refrigerant, the main circuit includes a first pipe configured to communicate with the indoor heat exchanger, a second pipe configured not to extend through the supercooling heat exchanger, and a third pipe configured to extend through the supercooling heat exchanger and communicate with the suction hole, the outdoor unit further includes a four-way valve configured to communicate the second pipe with the suction hole and communicate the outdoor heat exchanger with the discharge hole in the cooling operation, and configured to communicate the second pipe with the discharge hole and communicate the outdoor heat exchanger with the suction hole in a heating operation, the four-way valve is driven by a differential pressure between the suction hole and the discharge hole, the flow path switching valve is configured to communicate the first pipe with one of the second pipe and the third pipe and close the other of the second pipe and the third pipe, the second flow path is formed by communicating the first pipe with the second pipe, the third flow path is formed by communicating the first pipe with the third pipe, and the controller is configured to control the flow path switching valve to communicate the first pipe with the third pipe and then communicate the first pipe with the second pipe, when switching from the cooling operation to the heating operation.

5. The air conditioning apparatus according to claim 1, wherein the at least one indoor unit includes a plurality of indoor units, and the parameter is the number of indoor units that are being operating among the plurality of indoor units.

6. The air conditioning apparatus according to claim 5, wherein the compressor is provided with a suction hole configured to suction the refrigerant, and a discharge hole configured to discharge the refrigerant, the main circuit includes a first pipe configured to communicate with the indoor heat exchanger, a second pipe configured not to extend through the supercooling heat exchanger, and a third pipe configured to extend through the supercooling heat exchanger and communicate with the suction hole, the outdoor unit further includes a four-way valve configured to communicate the second pipe with the suction hole and communicate the outdoor heat exchanger with the discharge hole in the cooling operation, and configured to communicate the second pipe with the discharge hole and communicate the outdoor heat exchanger with the suction hole in a heating operation, the four-way valve is driven by a differential pressure between the suction hole and the discharge hole, the flow path switching valve is configured to communicate the first pipe with one of the second pipe and the third pipe and close the other of the second pipe and the third pipe, the second flow path is formed by communicating the first pipe with the second pipe, the third flow path is formed by communicating the first pipe with the third pipe, and the controller is configured to control the flow path switching valve to communicate the first pipe with the third pipe and then communicate the first pipe with the second pipe, when switching from the cooling operation to the heating operation.

* * * * *